US005971392A

United States Patent [19]

Lee

[11] Patent Number: 5,971,392

[45] Date of Patent: Oct. 26, 1999

[54] DEVICE FOR CALCULATING SHEET NUMBER IN A SHEET FEEDER AND METHOD FOR CALCULATING THE SAME

[75] Inventor: Jae-Sung Lee, Kyungki-do, Rep. of Korea

[73] Assignee: SamSung Electronics Co., Ltd., Kyungki-do, Rep. of Korea

[21] Appl. No.: 08/922,311

[22] Filed: Sep. 2, 1997

[30] Foreign Application Priority Data

Sep. 2, 1996 [KR] Rep. of Korea ..... 96-37922

[51] Int. Cl.[6] ..... B65H 7/02

[52] U.S. Cl. ..... 271/265.02; 271/265.04; 271/265.01; 271/147; 271/258.04

[58] Field of Search ..... 399/376, 389; 324/699, 712; 250/559.27; 271/263, 259, 258.04, 258.02, 265.02, 265.04, 147, 152, 153, 154, 265.5

[56] References Cited

U.S. PATENT DOCUMENTS

| | | | |
|---|---|---|---|
| 3,778,051 | 12/1973 | Allen et al. . | |
| 3,826,487 | 7/1974 | Förster et al. . | |
| 4,373,135 | 2/1983 | Mohan et al. . | |
| 4,462,587 | 7/1984 | Graef et al. . | |
| 4,503,960 | 3/1985 | Koeleman . | |
| 4,535,463 | 8/1985 | Ito et al. | 271/258.04 |
| 4,627,715 | 12/1986 | Kikuno . | |
| 4,662,816 | 5/1987 | Fabrig . | |
| 4,729,556 | 3/1988 | Fujii et al. . | |
| 4,734,747 | 3/1988 | Okuda et al. . | |
| 4,835,573 | 5/1989 | Rohrer et al. . | |
| 4,937,460 | 6/1990 | Duncan et al. | 271/263 |
| 4,953,842 | 9/1990 | Tolmie et al. | 271/263 |
| 5,011,128 | 4/1991 | Tsuji . | |
| 5,097,496 | 3/1992 | Madate . | |
| 5,145,163 | 9/1992 | Cowan et al. . | |
| 5,599,014 | 2/1997 | Kitahara et al. . | |
| 5,812,280 | 9/1998 | Kwan-Bo | 271/259 |
| 5,853,171 | 12/1998 | Halpenny | 271/259 |

FOREIGN PATENT DOCUMENTS

| | | | |
|---|---|---|---|
| 359064445 | 4/1984 | Japan | 271/152 |
| 0277529 | 12/1986 | Japan | 271/154 |

*Primary Examiner*—H. Grant Skaggs
*Attorney, Agent, or Firm*—Robert E. Bushnell, Esq.

[57] ABSTRACT

A device for calculating the number of recording papers on an automatic sheet feeder, including a sheet thickness detector, generating a sheet thickness value, and a sheet pile thickness detector, generating a sheet pile thickness value, which the processor divides by the sheet thickness value, generates and displays the number of the recording papers on the sheet feeder.

28 Claims, 10 Drawing Sheets

DEVICE FOR CALCULATING SHEET NUMBER IN A SHEET FEEDER AND METHOD FOR CALCULATING THE SAME

CLAIM OF PRIORITY

This application makes reference to, incorporates the same herein, and claims all benefits accruing under 35 U.S.C. §119 from an application entitled Device for Calculating Sheet Number in Ink Jet Recording Apparatus and Method for Calculating the Same earlier filed in the Korean Industrial Property Office on Sep. 2, 1997,and there duly assigned Ser. No. 96-37922 by that Office.

BACKGROUND OF THE INVENTION

1. Field of the Invention

The present invention relates to an image recording apparatus. More particularly, the present invention relates to a device for calculating a sheet number of recording papers piled up on an automatic sheet feeder (ASF) in an image recording apparatus and a method for calculating the same.

2. Description of the Prior Art

An image recording apparatus, such as a wire dot printer, a thermal printer, or ink jet printer, includes a unique recording head for recording image data on a recording medium such as a recording paper or overhead projector (OHP) film. These recording apparatuses generally include automatic sheet feeders guides to assure proper feeding of the recording papers through the apparatus. Conventional automatic sheet feeders typically do not apprize the user as to the number of sheets piled thereon. When the recording apparatus has print jobs which would exhaust the number of papers in the feeder, the user typically discovers same upon returning to collect the jobs after a sufficiently long period of time deemed necessary to complete the job and must re-supply the increasing the time needed to get the job done.

Several types of sheet feeding apparatus are disclosed in the patent literature. Unfortunately, the apparatuses described do not provide the features in the convenient simple manner of the preset invention does. For example, U.S. Pat. No. 4,503,960, issued Mar. 12, 1985, to G. A. A. Koeleman, describes a Method and Apparatus for Sensing a Supply of Sheets in a Magaziue. Referring to FIG. 1, the device includes a height sensor 1 which ascertains the height of a stack of sheet by unknown means. An equally unknowable calibration element 3 applies a conversion factor to the height signal to convert the height signal into a number of sheets.

U.S. Pat. No. 5,599,014, issued Feb. 4, 1997, to Y. Kitahara et al., describes a Sheet Conveyor Apparatus. Referring to FIG. 2 and column 4, lines 1–9, the device includes sheet thickness sensors 75*a* and 75*b*, each employing an optical sensor of the permeable type. Referring to lines 10–17, the thickness detector only ascertains and produces a signal for either a thick or thin sheet.

U.S. Pat. No. 5,145,163, issued Sep. 8, 1992, to K.P. Cowan et al., describes a Film Sheet Mode Magazine. Referring to FIG. 5 and column 7, lines 45–69, the device employs a primary feed roller 48 having a drive shaft which contacts a lever member 134. A pointer 130 is fixed to the lever member 134. The pointer corresponds to a thickness of films 12 relative to a sheet feeder bed and indicates same unremovable scale. Different scales may be substituted corresponding to estimated empirical thicknesses attributed to the sheet stock maintained in the sheet feeder.

U.S. Pat. No. 5,097,496, issued Mar. 17, 1992, to H. Madate, describes a Sheet Extracting Mechanism with Function for Detecting the Amount of Stacked Sheets and Recording Systemn Utilizing the Same. Referring to FIG. 1and column 4, lines 5–10, the film amount detecting mechanism detects a position where a suction cup picks up film stock and compares the measurement to a calibrated position where the suction cup would not be able to pick up a film stock.

U.S. Pat. No. 5,011,128, issued Apr. 30, 1991, to K. Tsuji, describes an Apparatus for Detecting the Thickness of Sheets. Referring to FIG. 1and column 7, lines 63–68, the invention includes an auxiliary roller 11, abutting against the movable roller 3, mounted on a detecting arm 12. The detecting arm is mounted to an angle sensor 13. The mechanics of the angle sensor are not disclosed.

U.S. Pat. No. 4,729556, issued Mar. 8, 1988, to K. Fujii et al., describes an Apparatus for Detecting the Thickness of Bank Notes. Referring to FIG. 1and column 3, lines 49–63, the device includes a detection roller 17 which is pushed upward when a sheet is received thereunder, rotating the detection arm 16 counterclockwise, actuating a potentiometer 23.

U.S. Pat. No. 4,734,747, issued Mar. 29, 1988, to M. Okuda et al., describes a Copying Machine with a Copy Paper Detection Device. Referring to FIG. 6 and column 6, lines 56–68, the device includes a light emitting element 52 and five light detecting elements 53*a*–53*e*. As the paper supply 55 diminishes, more sensors are exposed to light.

U.S. Pat. No. 4,835,573, issued May 30, 1989, C. Rohrer et al., describes a Machine Control System Utilizing Paper Parameter Measurements. Referring to FIG. 1and column 5, lines 33–68, the device includes an elevator mechanism in a copy supply bin 20 and an elevator motor 30, including a tachometer, to raise and lower the elevator. The paper supply bin also has a limit switch which is tripped by a stack of paper. Rohrer et al. describes calculating the sheet thickness by converting the output of the tachometer as sheets are removed and counted, and the elevator is elevated to maintain the sheets at a constant level.

U.S. Pat. No. 4,627,715, issued Dec. 9, 1989, to M. Kikuno, Describes a Programmable Copier. Referring to FIG. 5 and column 3, lines 7–20, the device includes three sets of light detectors 10*a*–10*c*, positioned at different heights within a sheet feeder bin.

U.S. Pat. No. 4,662,816, issued May 5, 1987, to P. Fabrig, describes a Method of Breaking up Stacks of Paper Sheets or the Like. Referring to FIG. 1and column 8, lines 34–62, the device includes a means 55 for monitoring thickness, including a reciprocal ram that is coupled to any of a number of dial gages, which may be changed depending on a predetermined notion of sheet thickness.

U.S. Pat. No. 4,462,587, issued Jul. 31, 1984, to H. T. Graef et al., Describes a Method of and System for Detecting Bill Status in a Papers Money Dispensing Machine. Referring to FIGS. 8A–8B and column 10, lines 21–34, the device includes electronic sensors 62 having rollers 60 in contact with rolls 56, 58, 54 or 52 of the apparatus. Paper or bills are not received between the sensor roller 60 and contacting roller 56, 58, 54 or 52.

U.S. Pat. No. 4,373,135, issued Feb. 8, 1983, to W. L. Mohan et al., describes a Pitch Matching Detecting and Counting System. Referring to FIG. 7 and column 5, lines 3–24, the device includes a single sensor 102 positioned relative to a stack of similar objects 104 and a light source 106. The light source is focused by a condensing lens 110 on the edges of the stack objects to form an illuminated area 112. The width of the slit formed between the masks is adjusted by positioning a pitch match dial 118, the width of the paper being ascertained therefrom.

U.S. Pat. No. 3,826,487, issued Jul. 30, 1974, to K. Forster et al., describes a Control Apparatus and Method for Transporting Sheets. Referring to FIGS. 3–6, and column 3, the device includes a magnitude sensor 8 having a transducer 9 mounted thereon. As the sensor is strained, the transducer generates a signal corresponding to the sheet thickness. Alternatively, referring to FIG. 5, the device may include a sensor 8" with a sensing piston 34 that contacts the sheets. The rear portion 34*a* of the sensing piston interrupts a light beam issued from a light source 36 toward a photoelectric matrix 35.

U.S. Pat. No. 3,778,051, issued Dec. 11, 1973, to J. H. Allen et al., describes a Superposed Sheet Detector. Referring to FIG. 1and column 3, line 60 through column 4, line 7, the device includes a transducer 101 adapted to produce a signal proportional to the thickness of a sheet material. The device also may employ a proximity detector between rollers conveying the sheets.

I have found that the art represented by the above demonstrates a lack of recognition of the need for a device which measures the thickness of a recording medium, by means of light intensity, and the thickness of a stack of recording media so as to apprize a user with the number of sheets available.

None of the above references, taken alone or in combination, are seen as teaching or suggesting the presently claimed device for calculating sheet number in a sheet feeder and method for calculating same.

SUMMARY OF THE INVENTION

The present device for calculating a sheet number of recording papers on an automatic sheet feeder includes a sheet thickness detector that generates a sheet thickness value and a sheet pile thickness detector that generates a sheet pile thickness value. The sheet pile thickness detector contemplates a slide resistor, having an adjusting lever interlocked with a sheet support, which moves according to amount of the recording papers piled up on the automatic sheet feeder. The slide resistor divides the voltage thereacross according to the thickness of the sheet pile on the automatic sheet feeder. An analog-to-digital converter converts the resultant voltage into a sheet pile thickness detection value. The sheet thickness sensor includes a lever arm having a reflective surface, on which a roller is mounted. A sheet is received between the roller and a sheet feeding area, typically the platen just prior to entry into the image transferring area. The sheet urges the lever, thus the reflective surface, to rotate. A light beam reflected from a light source and received at a light sensor diminishes in intensity, which is converted into a sheet thickness value. The sheet pile thickness value is divided by the sheet thickness value to calculate the sheet number of the recording papers on the automatic sheet feeder.

A first object of the invention to provide a sheet number calculating device and a method for calculating the sheet number.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
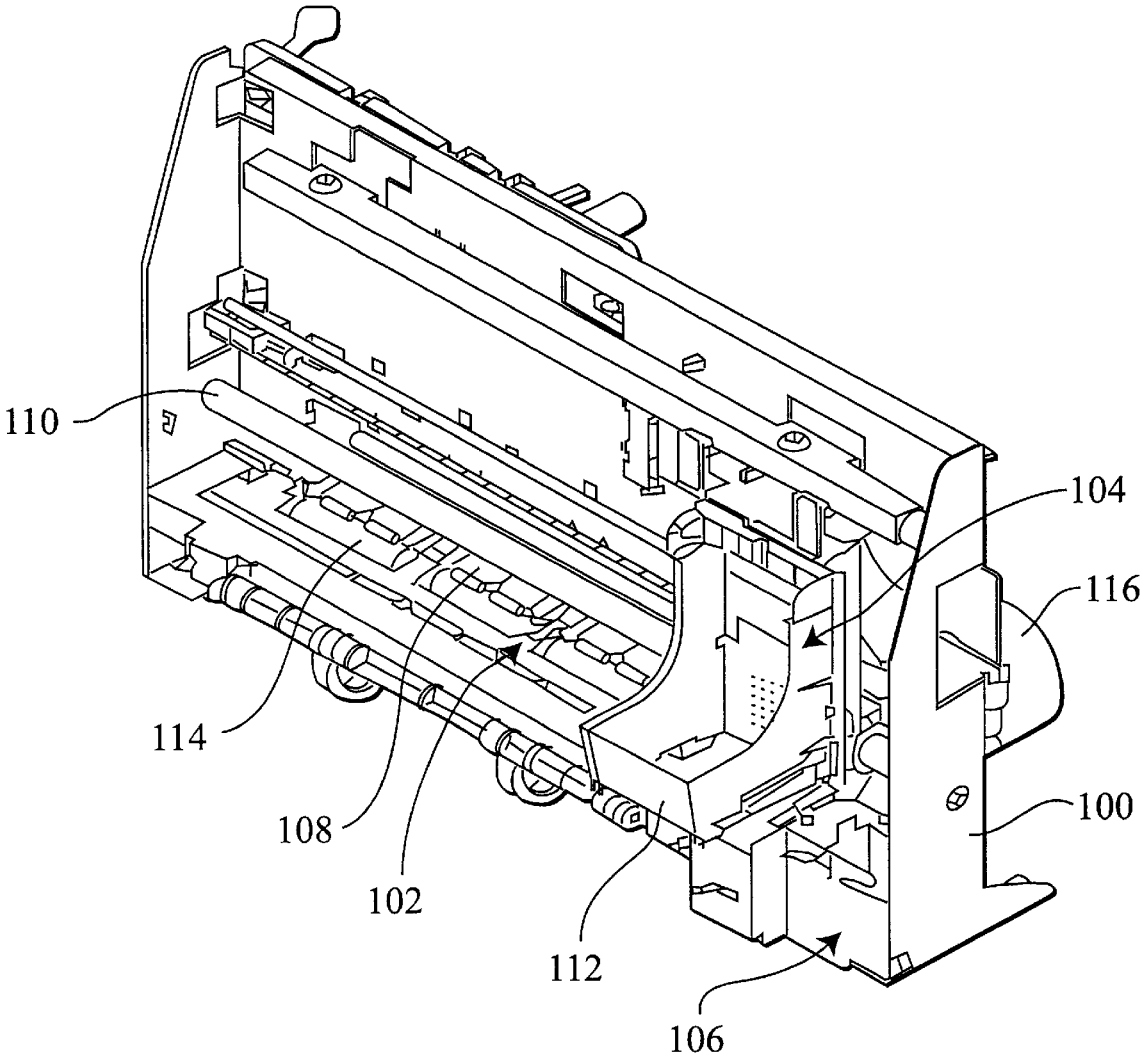
FIG. 1 is a front perspective view of a sheet feeder apparatus of a common recording apparatus.
Figure 2:
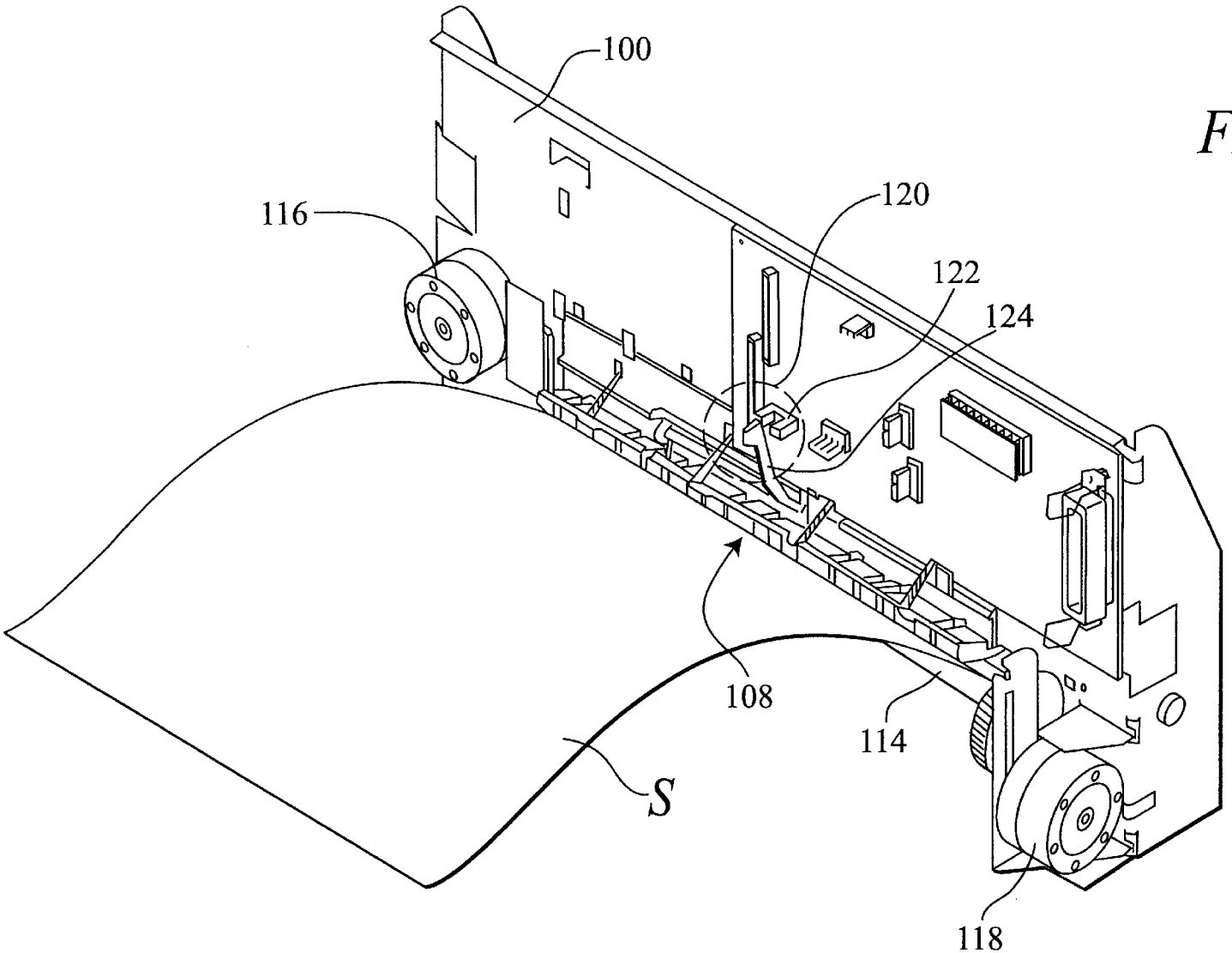
FIG. 2 is a rear perspective view of the mechanism shown in FIG. 1, receiving a sheet of recording stock.

Referring to FIGS. 1 and 2, a typical printer includes a line feed mechanism 102, a carriage mechanism 104, a home assembly 106, a friction roller assembly 108, a carriage motor 116, and a line feed motor 118. The above mentioned elements are installed in a frame 100.

Figure 3:
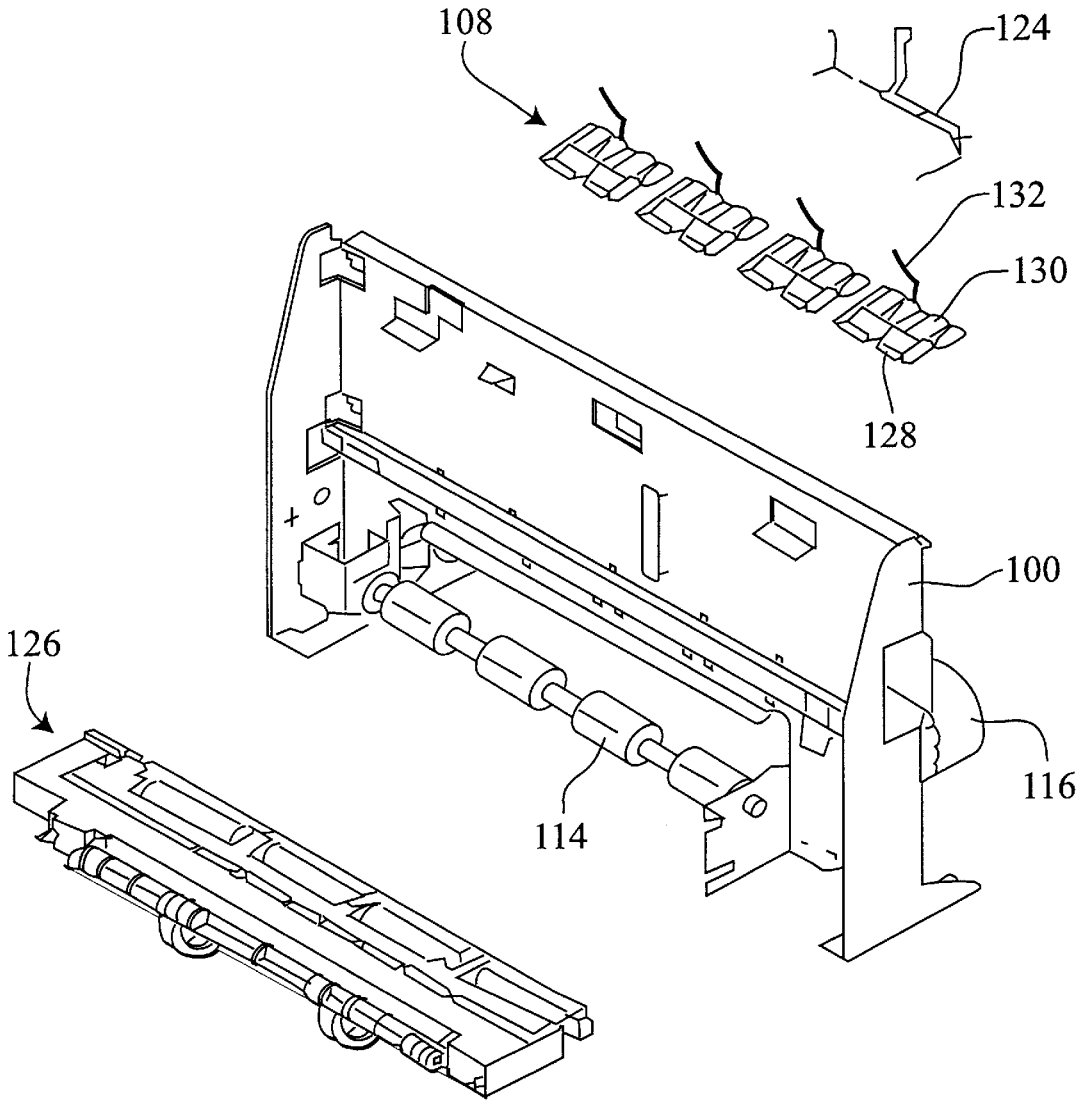
FIG. 3 is an exploded perspective of the line feed mechanism and a friction roller assembly of FIG. 1.

Referring also to FIG. 3, the line feed mechanism 102 includes a frame base assembly 126 and a feed roller 114. The line feed mechanism 102 transfers a recording paper S from an automatic sheet feeder (not shown) toward a carriage 112 of the carriage mechanism 104. The recording head is mounted at a lower surface of the ink cartridge, so as to face to the surface of the recording paper. When the recording paper S reaches a contact surface between the feed roller 114 and the friction roller 128 and is inserted therebetween, the recording paper S will be conveyed toward the recording head by the feed roller 114 which is revolved by the line feed motor 118. Some printing mechanisms transfer an image to a sheet while the sheet rests on a flat platen. The recording paper S is ejected to the exterior after recording.

Whether the recording paper S reached the contact surface between the feed roller 114 and the friction roller 128 is sensed by a sheet-detecting, sensor 120. The sheet-detecting sensor employs an optical sensor 122 and an actuator feed 124. The actuator feed 124 is mounted at the front of the feed roller 114 and the friction roller 128. The actuator feed 124 is pivotally moveable by the front end of the recording paper S being fed, oriented such that an optical path between the light-emitting element and the light-receiving element of the optical sensor 122 may be interrupted by the paper. When the light receiving element receives a light beam from the light-emitting element of the optical sensor 122, it is recognized that the recording paper S has reached the contact surface between the feed roller 114 and the friction roller 128.

Figure 4:
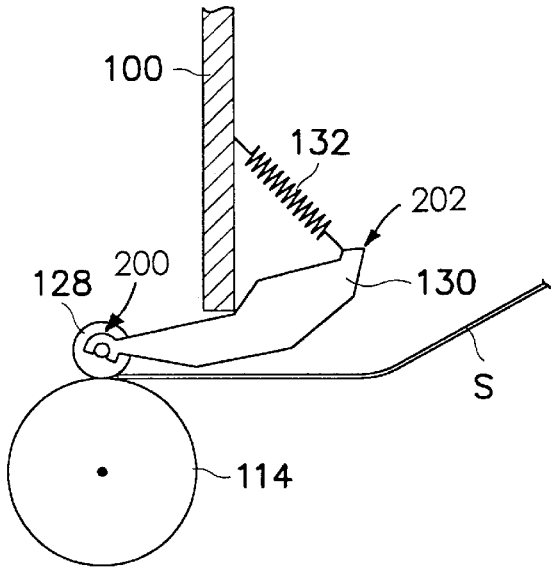
FIG. 4 is a diagrammatic representation of the feed and friction roller assembly of FIG. 3, conveying a sheet of recording stock.

Referring also to FIG. 4, the friction roller assembly 108 includes a number of sub assemblies, including a friction roller 128, a friction roller guide 130 and a spring 132, which cooperate to urge the recording paper against the feed roller 114. The friction rollers 128, mounted on an axes parallel to the feed roller 114, contact the feed roller 114. The friction roller guide 130 has an end 200 connected to the friction roller 128, and another end 202 connected to the frame 100 via the spring 132. The force of the spring 132 against the end 202 levers the end 200, and roller 128, against the roller 114.

When the recording paper S reaches the feed roller 114, the friction roller 128 draws in and transfers the recording paper S toward the recording head. When this occurs, the friction roller 128 is lifted up by an amount corresponding to the thickness of the recording paper S and the ends 202 of the friction roller guide 130 moves a like distance.

Figure 5:
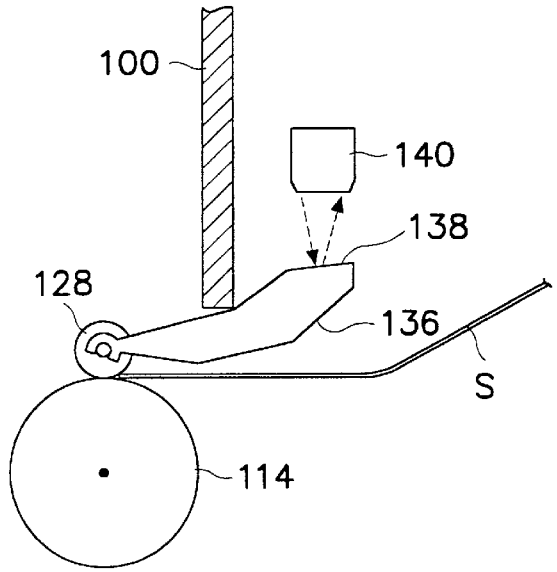
FIG. 5 is a diagrammatic representation of the sheet thickness detection mechanism.

Referring to FIG. 5, the sheet thickness detection mechanism of the present invention includes a friction roller guide 136 with a reflection surface 138 formed at an end thereof, and a reflection type optical sensor 140 directed toward the reflection surface 138. Initially, a reference intensity of the light beam reflected on the reflection surface 138 is determined. When recording paper S is drawn between the rollers 114 and 128, the friction roller 128 is lifted up and the reflection surface 138 falls down correspondingly. Since the movement of the reflection surface 138 corresponds to the thickness of the recording paper S, the distance between the reflection surface 138 and the optical sensor 140 varies according to the thickness of the recording paper S. As a result, the intensity of the reflected light beam of the optical sensor 140 varies in proportion to the thickness of the recording paper S. Specifically, the thicker the recording paper S is, the lower the intensity of the reflected light beam becomes. Responsive to the intensity, the optical sensor 140 generates a detection voltage signal which varies according to the intensity of the reflected light beam. Since the optical sensor 140 generally has linear output characteristics, the voltage characteristics of the sensing signal also is linear with respect to the intensity of the reflected light beam. Accordingly the thickness of the recording paper is converted into a discrete voltage level.

Figure 6:
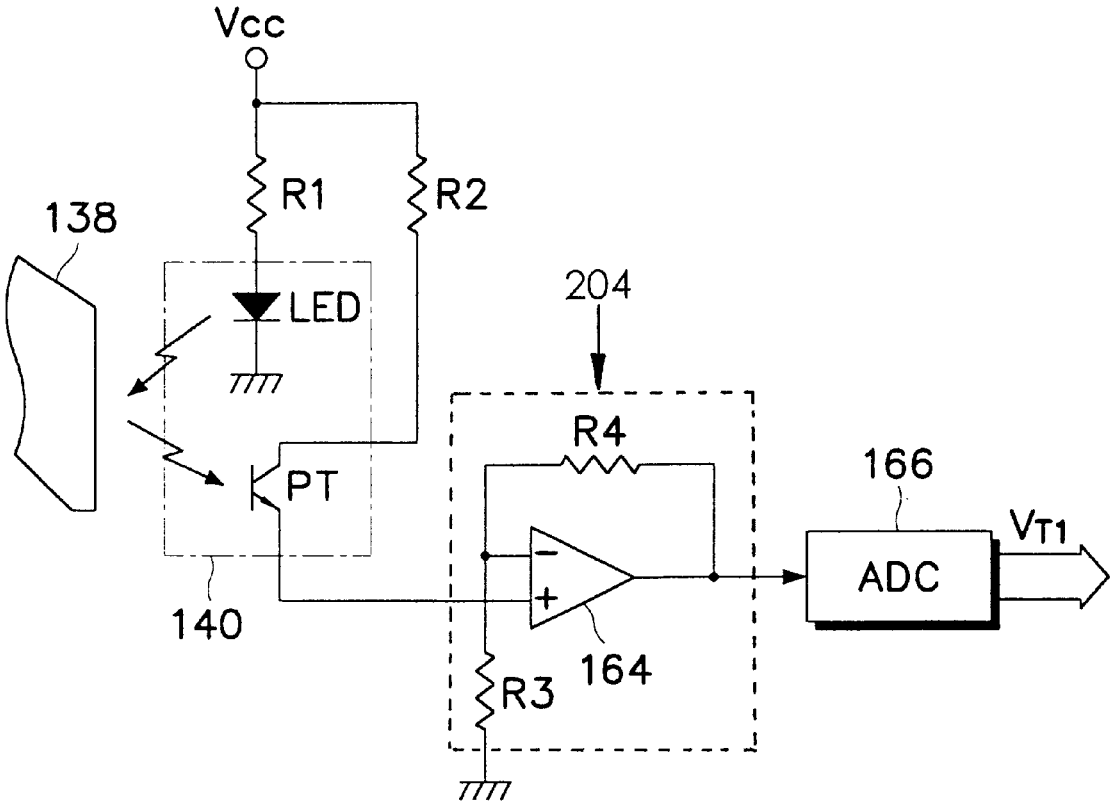
FIG. 6 is a detailed circuit diagram pertaining to the optical-electric sheet thickness detector of the constructed according to the principles of the present invention.

Referring to FIG. 6, the sheet thickness detector circuitry includes the optical sensor 140, an amplifier 204, for amplifying the sensing signal output from the optical sensor 140, and an analog-to-digital converter (ADC) 166, for converting an output of the amplifier 164 into digital data. The optical sensor 140 includes a light-emitting diode (LED), the light emitting element, and a photo transistor (PT), the light-receiving element. The LED is forward-connected to the supply voltage Vcc via a resistor R1. The photo transistor PT is connected between the supply voltage Vcc, via a resistor R2, and a non-inverse input terminal of the amplifier 164. The photo transistor PT generates a sensing signal having a voltage level corresponding to the intensity of the reflected light beam. The sensing signal is amplified by the amplifier 164 and applied to the analog-to-digital converter 166. The converted digital data defines a sheet thickness detection value $V_{T1}$ which is received by a CPU (not shown) via an interface (not shown).

Figure 7:
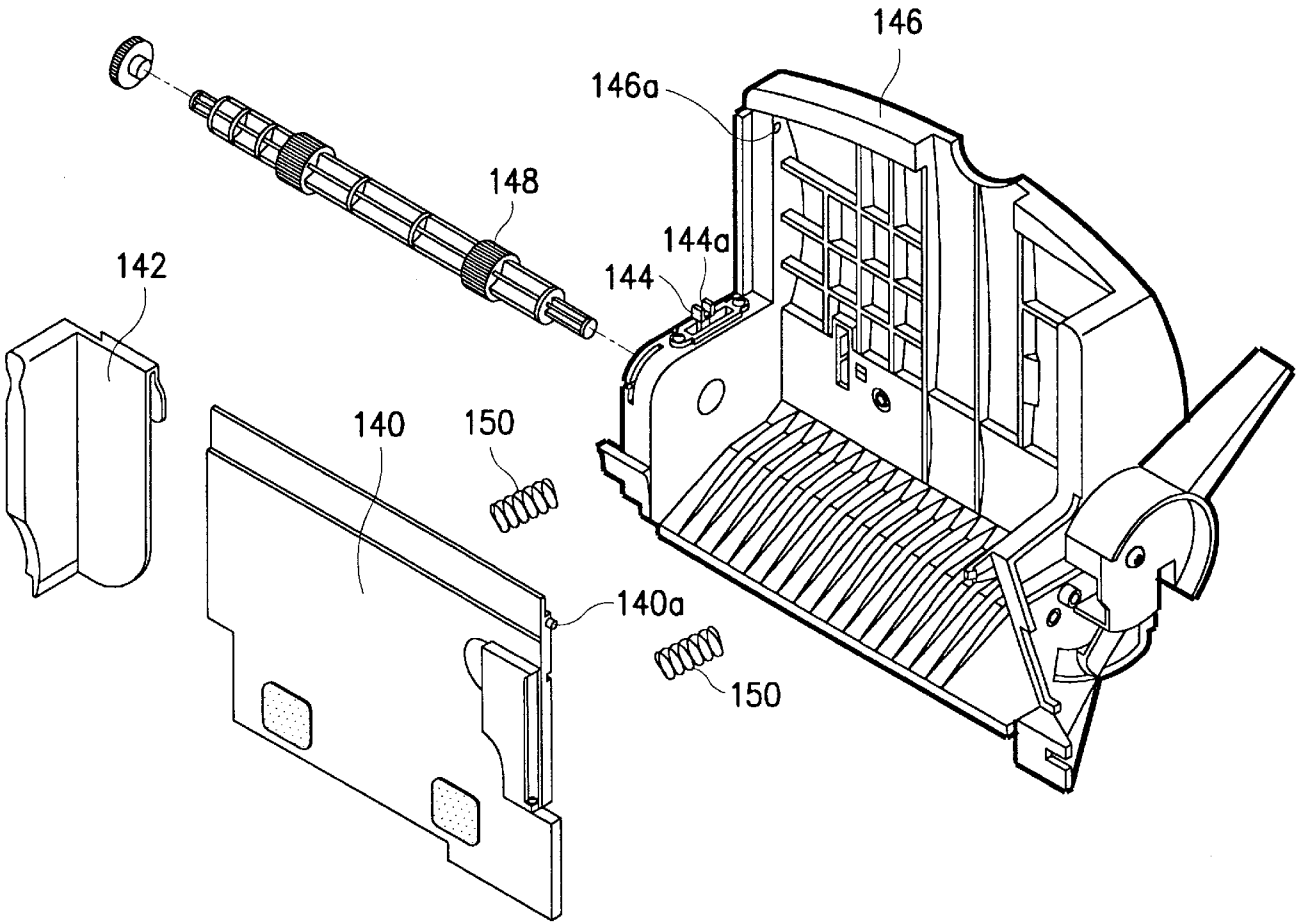
FIG. 7 is an exploded perspective view of an automatic sheet feeder and sheet support.
Figure 8:
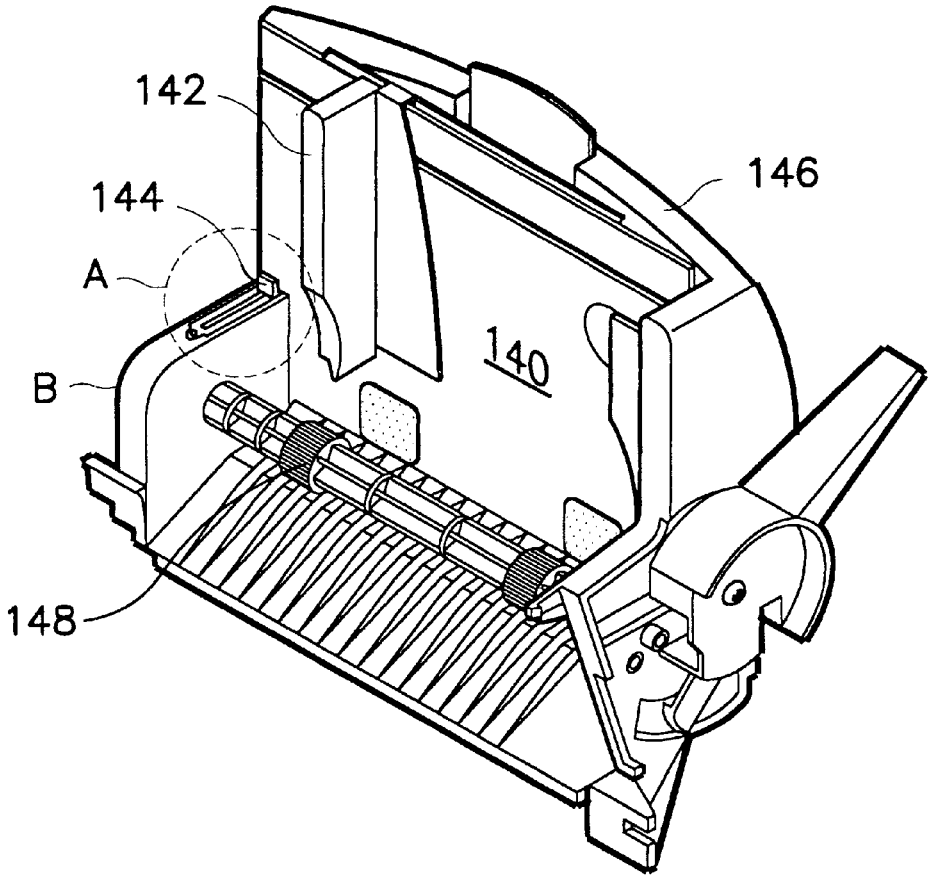
FIG. 8 is a perspective view of an automatic sheet feeder, including a slide resistor adjusting lever interlocked with a sheet support.
Figure 9:
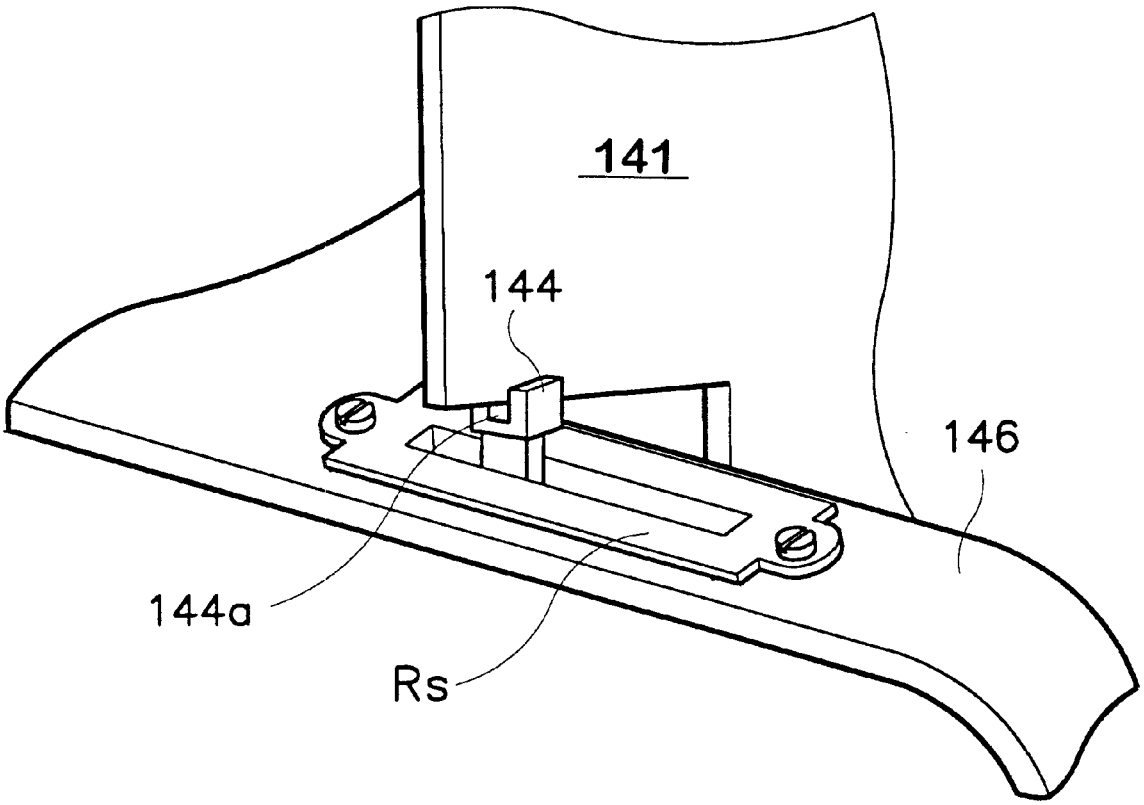
FIG. 9 is an enlarged diagram of the slide resistor adjusting lever interlocked with the sheet support.

Referring to FIGS. 7–9, an automatic sheet feeder according to the present invention includes a slide resistor Rs with an adjusting lever 144 mounted at a right side of a frame 146. The resistance of the slide resistor Rs varies according to the amount of the recording papers piled up on the sheet feeder. At a more detailed level, referring to FIG. 9, the slide resistor adjusting lever 144 may include a cutout 144*a* into which a portion of the sheet support 141 is inserted. The sheet support 141 is horizontally movable and corresponds to the amount of the recording papers piled up on the automatic sheet feeder. The slide resistor adjusting lever 144, interlocked with the sheet support 141, also is horizontally movable and corresponds to the sheet number of the recording papers piled up on the automatic sheet feeder. Accordingly, the resistance of the slide resistor Rs varies according to the sheet pile thickness.

Figure 10:
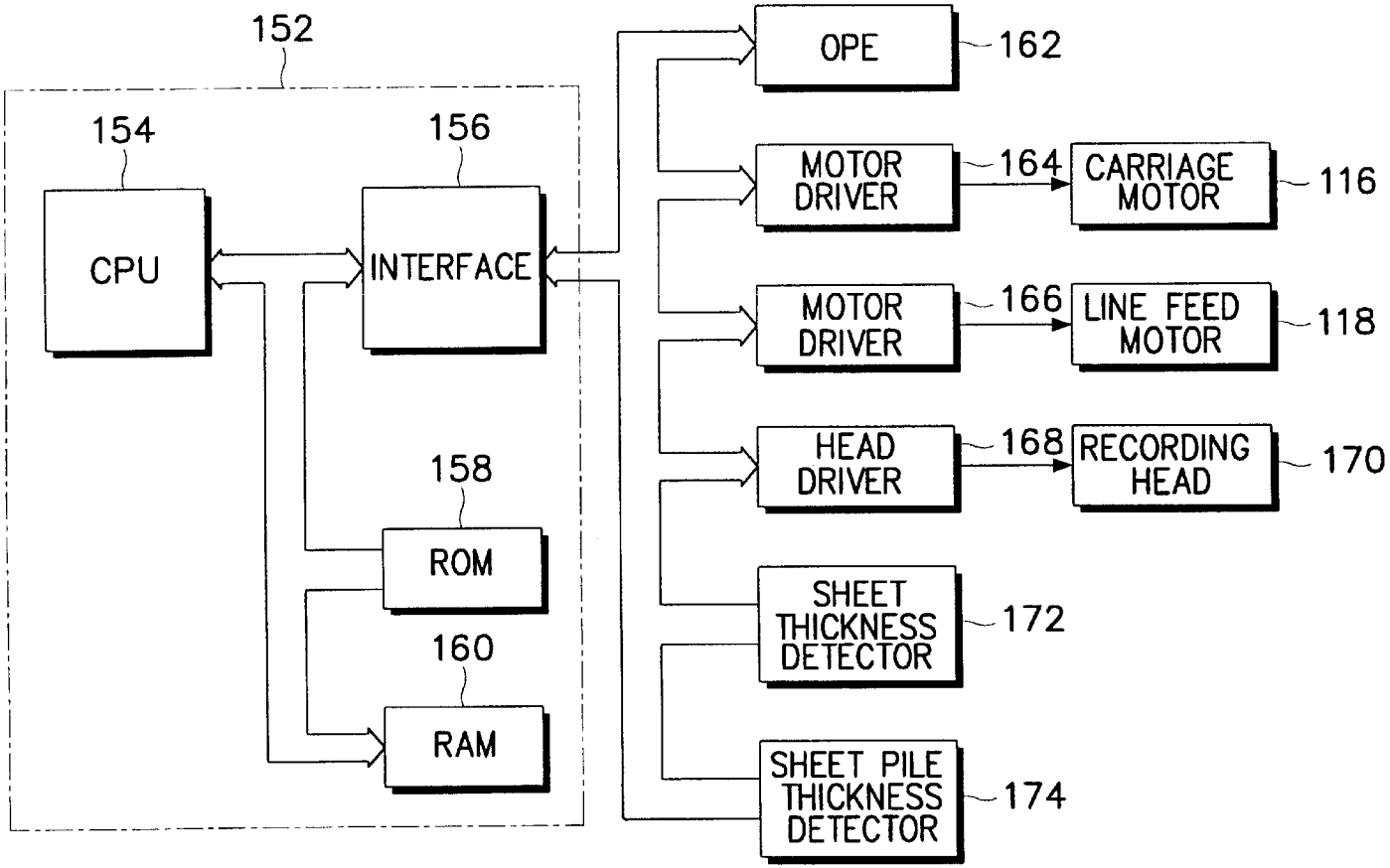
FIG. 10 is a flow diagram describing one process for the practice of the present invention.

Referring to FIG. 10, a recording apparatus according to the present invention includes an individual sheet thickness detector 172 and a sheet pile thickness detector 174. A controller 152 includes a Central Processing Unit (CPU) 154, an interface 156, a Read Only Memory (ROM) 158 and a Random Access Memory (RAM) 160. The CPU 154 executes a program stored in the ROM 158 that controls each part of the ink jet recording apparatus via the interface 156. The ROM 158 stores the control program of the CPU and initial data. The RAM 160 temporarily stores the data generated according to the operation of the CPU 154. The interface 156 interfaces the signals communicated between input/output devices, such as an operating panel (OPE) 162, monitor drivers 164 and 166, a head driver 168, sheet thickness detector 172, and sheet pile thickness detector 174. The operating panel 162 includes a number of buttons, for entering various commands, and a display, for displaying various operating states under the control of the CPU 154. The motor driver 164 drives the carriage motor 116 to move the carriage 112 vertically, under the control of the CPU 154. The motor driver 166 drives the line feed motor 118 to feed and transfer the recording paper S, under the control of the CPU 154. The head driver 168 drives a recording head 170, mounted on the carriage 112, to record the image on the recording paper S, under the control of the CPU 154. The recording head 170, records the image on the recording paper S. The sheet thickness detector 172 includes the optical sensor 140, shown in FIG. 6, and provides the CPU 154 with a sheet thickness value $V_{T1}$. The sheet pile thickness detector 174 detects the thickness of the sheet pile on the automatic sheet feeder based on the variation of the resistance of the slide resistor Rs which moves up and down according to the amount of the recording papers piled up on the automatic sheet feeder.

Figure 11:
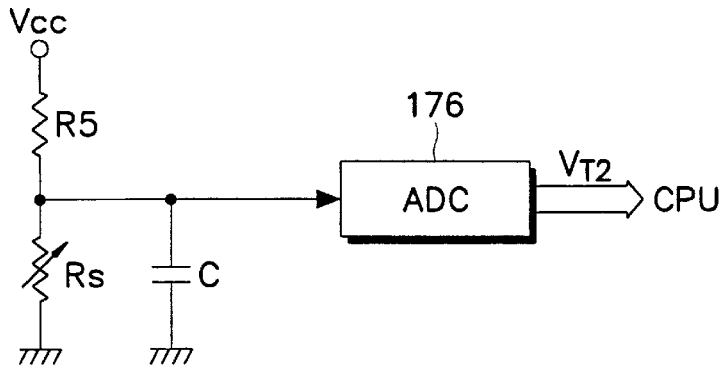
FIG. 11 is a circuit diagram pertaining to the present sheet pile thickness detector of FIG. 10.

Referring to FIG. 11, the sheet pile thickness detector 174, as shown on FIGS. 9 and 10, includes the slide resistor Rs, a resistor R5, a capacitor C, and an analog-to-digital converter (ADC) 176. The resistor R5 and the slide resistor Rs are connected in series between the supply voltage Vcc and the ground voltage to generate a division voltage:

$$V_S\left(= V_{CC}\frac{R_S}{(R_5 + R_S)}\right)$$

corresponding to the thickness of the sheet pile on the automatic sheet feeder. The capacitor C is connected between the ground and a node of the resistor R5 and the slide resistor Rs, to remove noises from the division voltage Vs. The analog-to-digital converter 176 converts the division voltage Vs into digital data to generate a sheet pile thickness value $V_{T2}$. The resistance of the slide resistor Rs varies according to the horizontal movement of the sheet support 141, which is interlocked with the adjusting lever 144 via the cut out at an end of the adjusting lever 144. In operation, when the recording papers are piled up on the automatic sheet feeder, the sheet support 141 will move outward. As a result, the adjusting lever 144 interlocked with the sheet support 141 also will move outward. The CPU 154 calculates the thickness of the sheet pile based on the sheet thickness detection value $V_{T1}$ and the sheet pile thickness value $V_{T1}$.

Figure 12:
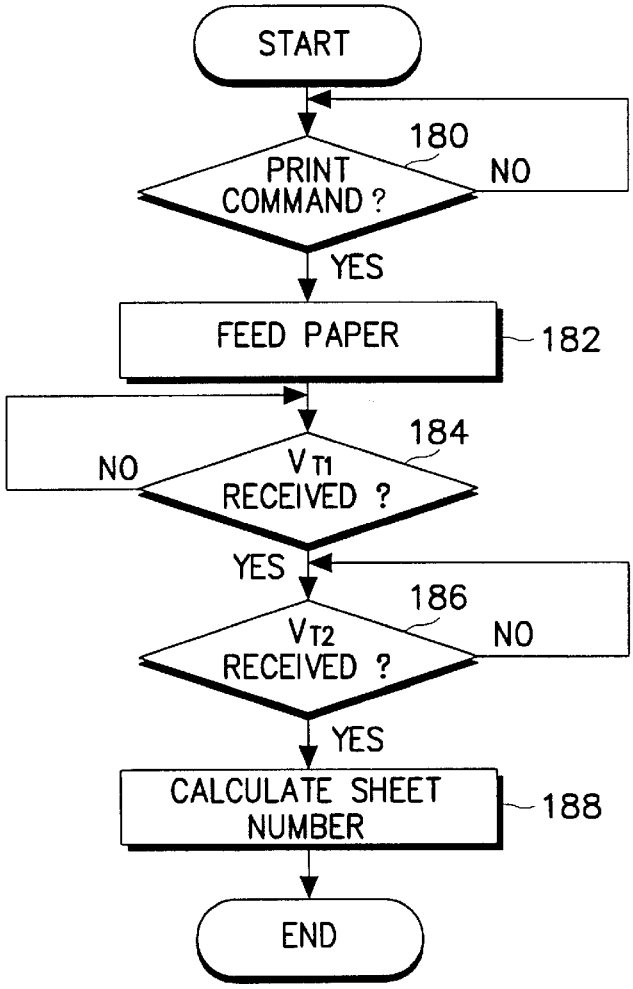
FIG. 12 is a flow chart of the present method for calculating a sheet number.

Referring to FIG. 12, the CPU 154 checks, at a step 180, whether a printing command is received from the host computer via a computer interface (not shown). If the printing command for printing an image has been received, the CPU 154 will feed a recording paper S from the sheet feeder, at a step 182. Then, the CPU 154 checks, at a step 184, whether a sheet thickness value $V_{T1}$ is received from the sheet thickness detector 172. If the value $V_{T1}$ is received, the CPU 154 checks again, at a step 186, whether a sheet pile thickness value $V_{T2}$, is received from the sheet pile thickness detector 174. If the data $V_{T2}$ is received, the CPU 154 calculates, at a step 188, the sheet number by dividing the sheet pile thickness value $V_{T2}$ by the sheet thickness value $V_{T1}$. If the printing image data received from the host computer requires a number of sheets that exceeds the sheet number of the recording papers piled up on the automatic sheet feeder, the operating panel 162 will generate a message requesting the user to supply the recording papers on the display prepared thereon, under the control of the CPU 154. Thus, the user may check, in advance, whether the automatic sheet feeder has enough recording paper to print the printing image data from the host computer on the sheets provided. This feature prevents a pause during printing due to a lack of the recording paper in the middle of the printing operation, thereby saving printing time.

Although preferred embodiments of the present invention have been described in detail above, it should be clearly understood that variations and/or modifications of the basic inventive concepts taught herein fall within the spirit and scope of the present invention as defined in the appended claims.

What is claimed is:

1. A sheet feeding apparatus, comprising:

a sheet thickness sensor comprising a first light sensor emitting a light beam along a path of conveyance of passing sheets drawn from a stack of a plurality of cut sheets of recording stock, with each of said sheets of said recording stock exhibiting a sheet thickness and said stack exhibiting a stack thickness, and a second light sensor responsive to said light beam, generating a sheet thickness value corresponding to variation in reflection of said light beam attributable to passage of the individual ones of said sheets;

a stack thickness sensor generating a stack thickness value corresponding to said stack thickness; and a processor generating a sheet number indicative of a number of said cut sheets of said recording stock in said stack in dependence upon said sheet thickness value and said stack thickness value.

2. The sheet feeding apparatus as recited in claim 1, said stack thickness sensor comprising:

a resistor having a resistance; and a lever contacting said resistor at a position that varies with the stack thickness and varies said resistance as a function of said stack thickness.

3. The sheet feeding apparatus as recited in claim 2, wherein the sheets are maintained vertically by said lever.

4. The sheet feeding apparatus as recited in claim 2, said blade being biased against the sheets.

5. The sheet feeding apparatus as recited in claim 1, further comprised of said sheet thickness sensor including a guide having a surface reflecting said light beam.

6. The sheet feeding apparatus as recited in claim 5, said guide rotating, responsive to a sheet drawn from a stack of sheets, defining a rotation proportional to the sheet thickness.

7. The sheet feeding apparatus as recited in claim 5, said surface retreating from said light source, responsive to a sheet drawn from a stack of sheets, defining a distance proportional to the sheet thickness.

8. The sheet feeding apparatus as recited in claim 5, further comprised of a roller mounted on said guide.

9. The sheet feeding apparatus as recited in claim 8, said roller contacting the sheet drawn from a stack of sheets.

10. The sheet feeding apparatus as recited in claim 9, said roller being biased against the sheet.

11. A sheet feeding apparatus, drawing sheets of recording stock from a stack of sheets, wherein each sheet has a sheet thickness and the stack has a stack thickness, comprising:

a sheet thickness sensor generating a sheet thickness value corresponding to the sheet thickness;

a stack thickness sensor generating a stack thickness value corresponding to the stack thickness; and a processor receiving said sheet thickness value and said stack thickness value and generating a sheet number;

said stack thickness sensor comprising:

a resistor having a resistance; and a lever contacting said resistor at a position that varies with the stack thickness and varies said resistance as a function of said stack thickness.

12. The sheet feeding apparatus as recited in claim 11, wherein the sheets are maintained vertically by said lever.

13. The sheet feeding apparatus as recited in claim 11, said lever being biased against the sheets.

14. A method for determining a number of sheets in a sheet feeder comprising the steps of:

gauging a stack of sheets having a stack thickness;

generating a sheet stack thickness value based on the stack thickness;

gauging a sheet having a sheet thickness;

generating a sheet thickness value based on the sheet thickness; and generating a sheet number indicative of a number of sheets within the stack, in dependence upon said stack thickness value and said sheet thickness value.

15. The method as recited in claim 14, further comprised of performing said step of gauging a stack by using a stack thickness sensor comprising:

a resistor having a resistance; and a wiper contacting said resistor at a position and varying said position with the stack thickness;

wherein said resistance varies with said stack thickness.

16. The method as recited in claim 15, wherein the sheets are maintained vertically by said wiper.

17. The method as recited in claim 15, said wiper being biased against the sheets.

18. The method as recited in claim 14, said step of gauging a stack of sheets including a sheet thickness sensor comprising:

a light source producing a light beam having an intensity; and a light sensor, responsive to said light source, generating a value proportional to said intensity.

19. The method as recited in claim 18, said sheet thickness sensor including a guide having a surface reflecting said light beam.

20. The method as recited in claim 19, said guide rotating, responsive to a sheet drawn from a stack of sheets, defining a rotation proportional to the sheet thickness.

21. The method as recited in claim 19, said surface retreating from said light source, responsive to a sheet drawn from a stack of sheets, defining a distance proportional to the sheet thickness.

22. The method as recited in claim 19, including a roller mounted on said guide.

23. The method as recited in claim 22, said roller contacting the sheet drawn from a stack of sheets.

24. The method as recited in claim 23, said roller being biased against the sheet.

25. A sheet number sensing apparatus, comprising:

a frame of an automatic sheet feeder;

a feed roller installed in said frame;

a sheet support installed in said frame, a cut sheet being loadable between said feed roller and said sheet support;

a sensor responding to said sheet support by generating a stack thickness signal;

a processor responding to said stack thickness signal and a sheet thickness value stored in said processor by generating a sheet number indicative of a number of sheets within a stack formed by a plurality of the cut sheet.

26. The apparatus of claim 25, further comprised of said sensor including a lever contacting said sheet support, installed in said frame.

27. The apparatus of claim 25, further comprised of said stack thickness signal varying in synchronization with a movement of said sheet support.

28. A sheet feeding apparatus, comprising:

a sheet thickness sensor comprising a first sensor along a path of conveyance of sheets drawn from a stack of a plurality of cut sheets of recording stock, with each of said sheets of said recording stock exhibiting a sheet thickness and said stack exhibiting a stack thickness, and a second sensor responsive to said signal, generating a sheet thickness value corresponding to variation of said signal attributable to passage of the individual ones of the sheets;

a stack thickness sensor generating a stack thickness value corresponding to said stack thickness; and a processor generating a sheet number indicative of a number of said sheets of said recording stock in the stack in dependence upon said sheet thickness value and said stack thickness value.

* * * * *